United States Patent [19]

Cargnel

[11] Patent Number: 4,819,915

[45] Date of Patent: Apr. 11, 1989

[54] FLEXIBLE BARRIER FOR ARRESTING FALLING ROCKS

[76] Inventor: Gianangelo Cargnel, Viale Fantuzzi, 8, I-32100 Belluno, Italy

[21] Appl. No.: 42,941

[22] PCT Filed: Jul. 25, 1986

[86] PCT No.: PCT/EP86/00440

§ 371 Date: Apr. 29, 1987

§ 102(e) Date: Apr. 29, 1987

[87] PCT Pub. No.: WO87/00878

PCT Pub. Date: Feb. 12, 1987

[30] Foreign Application Priority Data

Jul. 31, 1985 [IT] Italy ..... 21809 A/85

[51] Int. Cl.[4] ..... E01F 7/02; B64F 1/02

[52] U.S. Cl. ..... 256/12.5; 256/13.1; 256/35; 244/110 C; 244/110 F

[58] Field of Search ..... 256/12.5, 23, 37, DIG. 2, 256/35, 36, 73.1; 244/110 C, 110 F

[56] References Cited

U.S. PATENT DOCUMENTS

| | | | |
|---|---|---|---|
| 1,857,435 | 5/1932 | Cole . | |
| 1,877,074 | 9/1932 | Stanziale . | |
| 3,351,322 | 11/1967 | Mueller | 256/13.1 |
| 4,339,114 | 7/1982 | Deike | 256/12.5 |
| 4,366,949 | 1/1983 | Staub, Sr. | 256/12.5 X |
| 4,730,810 | 3/1988 | Ramband | 256/35 X |

FOREIGN PATENT DOCUMENTS

| | | | |
|---|---|---|---|
| 957223 | 1/1957 | Fed. Rep. of Germany . | |
| 1073523 | 1/1960 | Fed. Rep. of Germany . | |
| 1459843 | 1/1969 | Fed. Rep. of Germany . | |
| 1534486 | 11/1969 | Fed. Rep. of Germany | 256/12.5 |
| 1190613 | 10/1959 | France . | |
| 1382258 | 11/1963 | France | 256/13.1 |
| 2098653 | 3/1972 | France . | |
| 2180263 | 11/1973 | France . | |
| 2414586 | 8/1979 | France . | |
| 2457929 | 12/1980 | France . | |
| 580285 | 7/1958 | Italy | 256/12.5 |
| 539170 | 8/1973 | Switzerland . | |
| 603911 | 8/1978 | Switzerland | 256/12.5 |
| 1012212 | 12/1965 | United Kingdom | 256/13.1 |
| 1303218 | 1/1973 | United Kingdom . | |
| 1362550 | 8/1974 | United Kingdom . | |
| 2172027 | 9/1986 | United Kingdom | 256/12.5 |

*Primary Examiner*—Randolph A. Reese
*Assistant Examiner*—Peter M. Cuomo
*Attorney, Agent, or Firm*—Young & Thompson

[57] ABSTRACT

A flexible barrier is provided for arresting falling rocks comprising posts and a rock collecting and arresting net. Each post pivots upon a ground-anchored base plate and is stayed by windbracing cables secured to the top of the post. Two of the cables extend in an upstream direction from the post and one cable extends in a downstream direction from the post. The net is placed on and secured to a series of spaced, longitudinal, horizontal ropes which are supported by the upstream windbracing cables. The horizontal ropes are connected to the cables in a manner which permits the ropes to slide freely, with the ends of the ropes being secured to ground anchoring means beyond the ends of the barrier.

5 Claims, 3 Drawing Sheets

FLEXIBLE BARRIER FOR ARRESTING FALLING ROCKS

BACKGROUND OF THE PRESENT INVENTION

The present invention relates to flexible barriers. These are normally erected on slopes to protect manufactured articles such as railways, roads, villages, etcetera, from the fall of boulders.

The walls of traditional crash barriers are made up of a series of vertical poles placed a few meters apart from each other; between these, metal sheet section irons are placed,, that sustain the impact of falling boulders. This type of barrier has been shown to be very expensive: in fact it has to be extremely strong in order to take up the thrust of the impact of a boulder.

Furthermore, after every collapse, one must take care to repair such a barrier.

Other crash barriers have been studied, so-called elastic barriers, which have between two rigid vertical poles, a flexible metallic net, or a series of steel cables, arranged horizontally with a distance between them of 0.2–0.3 m, which can better take up the thurst of the impact of the falling boulders.

This structure, even if cheaper and having a longer lifespan than the rigid one, still doesn't solve the problem of the poles; these are in fact subject to breakages caused by boulders falling directly on them.

The patent FR 1.190.613 envisages poles pivoted at the lower end, and a net anchored at points along its perimeter, so that it becomes subdivided in triangles fixed at their vertices, which act independently to one another, In this case, the energy dissipation due to the falling boulder must always occur in a very limited area, thus diminishing the total load that the structure can support.

OBJECTS AND SUMMARY OF THE INVENTION

The aim of the present invention is thus to realize a crash barrier that is more resistant to impact and less subject to breakage, and thus, as a whole, cheaper than the already known crash barriers.

The above aim was attained by forseeing the sustaining poles of the barrier as hinged to a pillar or a plinth in the ground, and kept in position by a group of windbracing cables, whilst the net is sustained by a series of horizontal ropes freely sliding on the windbracing cables placed upstream, so that, at rest, the net is some distance from the poles.

Preferably, the pole is fixed to the ground in such a way as to have two degrees of free rotation.

The fixed position of every pole is ensured by two upstream and one downstream windbracing cables.

Preferably, the poles are held by the windbracing cables in such a way as to become almost perpendicular to the surface of the ground.

Furthermore, the sliding fitting between the windbracing cables and the ropes is achieved by means of two rope clamps inserted one inside the other.

The invention will now be clarified by means of an examplary embodiment that has been represented in the enclosed drawings, in which:

DETAILED DESCRIPTION OF THE INVENTION

Figure 1:
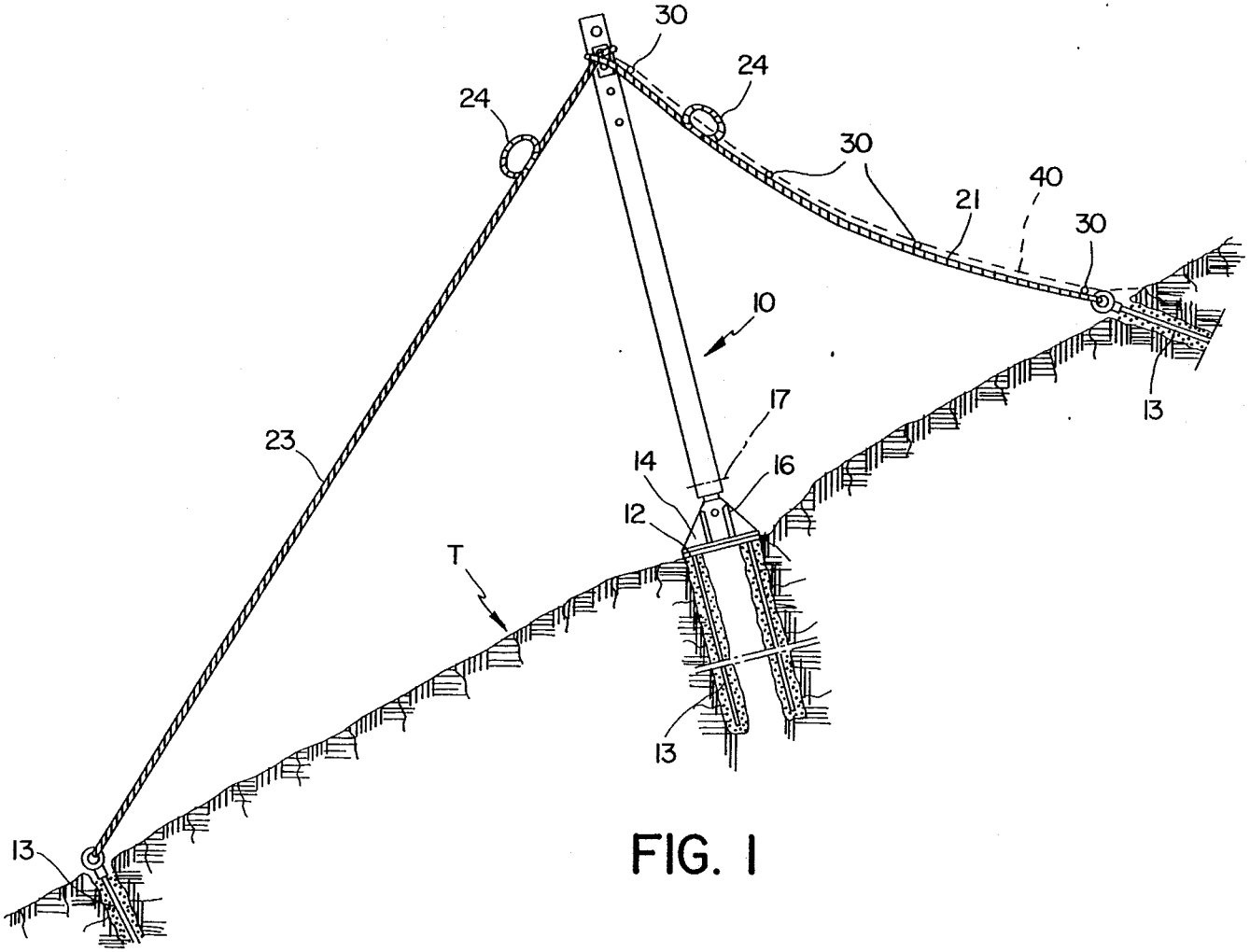
FIG. 1 is a side view of the whole structure of the proposed barrier.

Referring to the drawings, it will be noted that the crash barrier comprises poles 10 made up, for eg., by tube 11. The pole rests on the ground T by means of a base plate 12, which is fixed to the ground by anchoring means 13. To base plate 12, are attached a pair of gussets 14 that have two coaxial holes 14*a*. Between gussets 14, a plate 15 may be placed, which is provided with coaxial holes 15*a*. Through coaxial holes 14*a* and 15*a* is passed a pivot 16 that permits the reciprocal rotation of the two parts in the downstream-upstream direction and vice-versa. The plate 15 is equipped on the upper side with another hole 15*b*, perpendicular to the previous one, and bored in a head 15*c* that can be placed within tube 11. The latter is provided at its lower end with a hole 11*a* which can be made coaxial to hole 15*b*. Through holes 11*a* and 15*b* penetrates a pivot 17 that permits another rotation, at 90° to the rotation about pivot 16, so that the pole is fixed to the ground by means of a universal joint.

Figure 2:
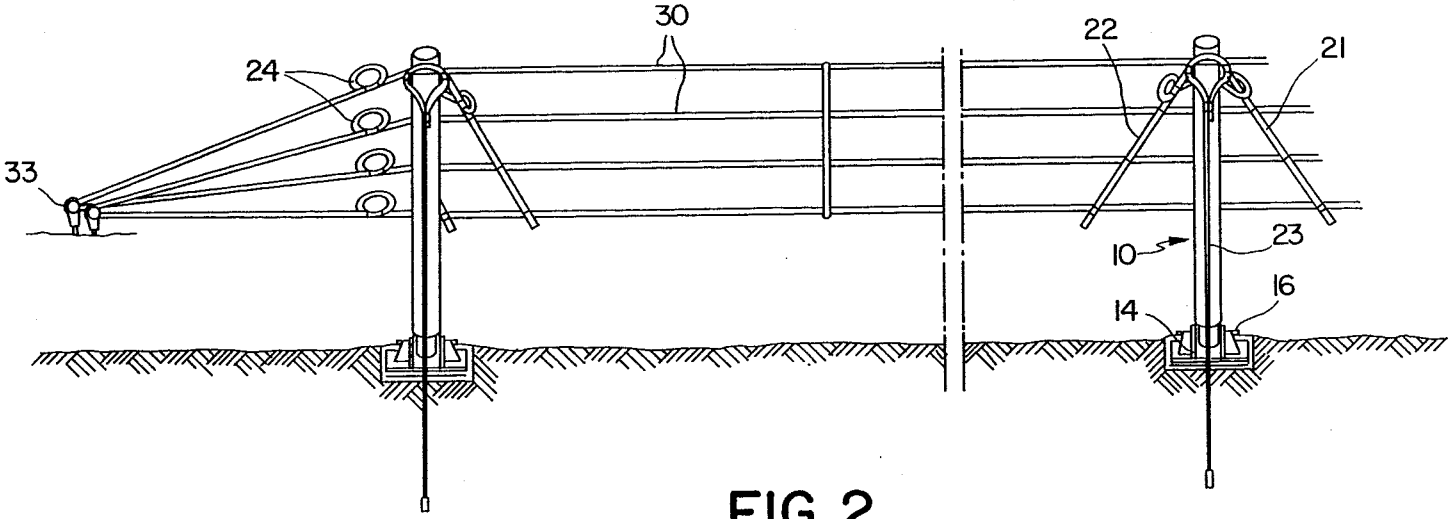
FIG. 2 is a front view of FIG. 1.
Figure 3:
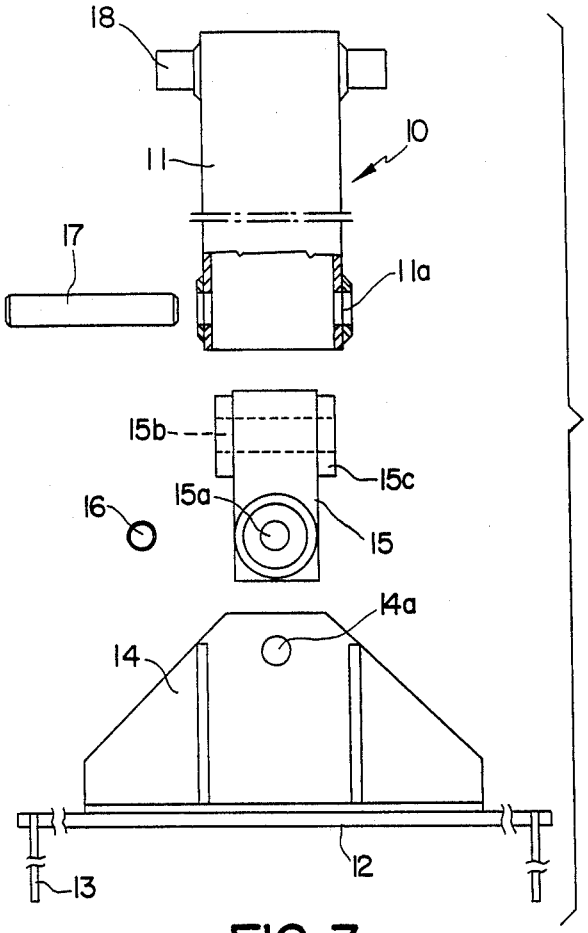
FIG. 3 is an exploded view of the pole and its means of attachment.
Figure 5:
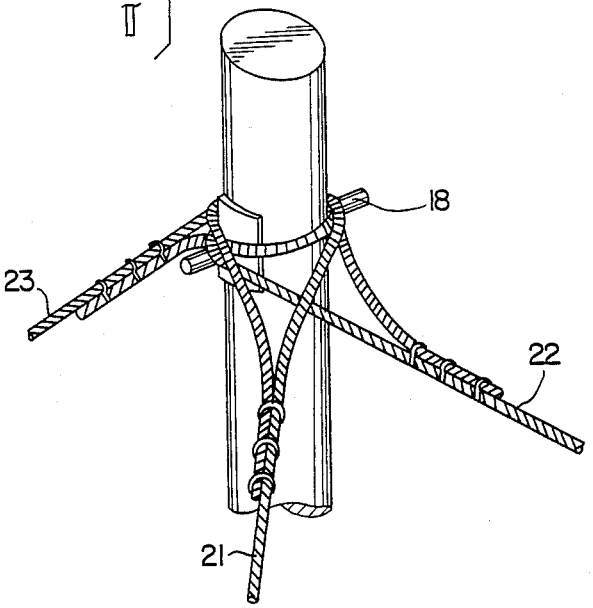
FIG. 5 is a perspective view showing the means of attachment of the windbracing cables to the pole.

The pole's upper side is provided with a pin 18 that permits the fixation of windbracing cables 21, 22, and 23, as illustrated in FIG. 5. The pole 10 is in fact kept in position by cables 21, 22, 23, two of which (21 and 22) are positioned upstream and form a triangle between each other, whilst the other (23) is placed downstream (FIGS. 1 and 2). Each one of these cables 21, 22 and 23 is fixed to the ground by anchoring means 13.

Figure 4:
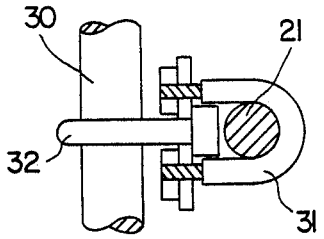
FIG. 4 is the view of the means of attachment of the ropes to the windbracing cables.

The horizontal ropes 30 rest freely on the windbracing cables 21 and 22 positioned upstream and are anchored on the side at 33, at the extremity of the cables (FIG. 2). In FIG. 4 a rope clamp 31 is shown on windbracing cable 21. Another clamp 32 is attached to which surrounds rope 30. The rope clamps surround rope 30 and cables 21, 22, 23 so as to enable reciprocal sliding, i.e. without being fixed in a definite position. On the horizontal ropes 30, a net 40 is placd and fixed in the known way. This net 40 is indicated with a broken line only in FIG. 1.

As visible from the drawings, both the windbracing cables 21, 22 and 23 and the ropes 30 are preferably provided with friction loops 24 which increase adaptation to strong boulder collisions.

I claim:

1. A structure for an elastic rockfall fence comprising a plurality of spaced poles (10) and an arresting net (40) extending therebetween for catching boulders;

said supporting poles (10) being each pivotally anchored to the ground (T) by anchor means permitting at least one degree of free rotation of the pole with respect to the ground (T);

each pole being maintained in position by a plurality of windbracing cables (21, 22, 23) anchored to the ground by anchoring means (13) and secured to the top of the pole;

wherein said windbracing cables (21, 22, 23) comprise upstream cables (21, 22) and downstream cable (23) with said holding net (40) being supported by a series of spaced horizontal ropes (30) mounted on the upstream windbracing cables (21, 22) so that the net (40), when at rest, is spaced from the poles (10), said horizontal ropes being mounted on said upstream windbracing cables (21, 22) in a manner which supports said ropes on said windbracing cables but permits lateral movement of said ropes along said windbracing cables, said horizontal ropes (30) being anchored at their extremities (33) so that in the event of the fall of a boulder, the arresting net coacts with the horizontal cables (30), the windbracing cables (21, 22, 23) and the poles (10) to serve as an elastic barrier.

2. A structure according to claim 1, wherein each pole (10) is fixed to the ground (T) in a manner which permits two degrees of rotation.

3. A structure according to claim 1, wherein said two upstream windbracing cables (21,22) are anchored to the ground upstream of the pole in spaced relation to one another so as to form a triangle the apex of which is the top of the pole, with another windbracing cable (23) being anchored to the ground downstream of the pole (10).

4. A structure according to claim 1, wherein said poles (10) are maintained substantially perpendicular to the ground by the windbracing cables (21, 22, 23).

5. A structure according to claim 1, wherein said ropes (30) are supported upon said upstream windbracing cables (21,22) by means of rings fixedly attached to said windbracing cables through which said ropes pass.

* * * * *